United States Patent [19]

Malet

[11] Patent Number: 4,567,696

[45] Date of Patent: Feb. 4, 1986

[54] INFLATABLE STRUCTURE FOR USE AS A SHELTER

[75] Inventor: Paul Malet, Talant, France

[73] Assignee: Compagnie Industrielle de Travaux Electriques & Mecaniques (CITREM), Chenove, France

[21] Appl. No.: 584,982

[22] Filed: Mar. 1, 1984

[30] Foreign Application Priority Data

Mar. 2, 1983 [FR] France ..... 8303393

[51] Int. Cl.[4] ..... E04B 1/34

[52] U.S. Cl. ..... 52/2; 52/222

[58] Field of Search ..... 52/2, 3, 4, 5, 23, 80, 52/82, 83, 222, 245, 247, 249

[56] References Cited

U.S. PATENT DOCUMENTS

| | | | |
|---|---|---|---|
| 3,116,746 | 1/1964 | Bird | 52/2 |
| 3,304,664 | 2/1967 | Duquette | 52/2 |

FOREIGN PATENT DOCUMENTS

| | | | |
|---|---|---|---|
| 2213869 | 10/1973 | Fed. Rep. of Germany | 52/2 |
| 1243346 | 8/1960 | France | 52/2 |
| 1309319 | 10/1962 | France | 52/2 |
| 2273126 | 12/1975 | France | 52/2 |
| 318700 | 12/1969 | Sweden | 52/2 |
| 1027437 | 4/1966 | United Kingdom | 52/2 |
| 2008646 | 6/1979 | United Kingdom | 52/2 |
| 2024588 | 1/1980 | United Kingdom | 52/2 |

*Primary Examiner*—Carl D. Friedman
*Assistant Examiner*—Naoko N. Slack
*Attorney, Agent, or Firm*—Young & Thompson

[57] ABSTRACT

An inflatable structure for totally enclosing a predetermined area such as a sports ground, swimming-pool and the like comprises a flexible envelope having a single or double wall which is placed during service over the area to be protected and a base which is anchored to the ground. The envelope is maintained in the distended condition during service by a pressure which exceeds atmospheric pressure. The wall or walls of the envelope are each joined to the base by means of a detachable assembly device such as a zipper-type slide fastener which permits assembly or disassembly of each wall independently of the other.

4 Claims, 8 Drawing Figures

INFLATABLE STRUCTURE FOR USE AS A SHELTER

This invention relates to an inflatable structure for use as a shelter in order to cover a predetermined area such as a tennis court, a swimming-pool, a playground or a sports ground in order to protect the area against bad weather conditions and in particular during the winter season or possibly for the purpose of shielding the area against excessive solar radiation.

Inflatable structures are already known which are formed by means of thin sheets of impermeable and flexible material, the sheets being maintained in the distended state by means of air pressure applied inside the structure.

Known types of inflatable structures which are employed at the present time usually comprise a flexible single-wall envelope consisting of a sheet having a base of plastic material, the density of which is at least 700 $g/m^2$. The sheet is securely anchored to the ground in order to withstand forces generated by the internal air pressure and by wind.

In another type of inflatable structure which is also known, the flexible envelope has a double wall which provides a certain degree of heat and sound insulation.

The double walls of these structures are secured to the ground by means of fastening devices so designed and arranged that walls of this type cannot readily be disassembled.

It is found in practice, however, that the outer wall suffers degradation in a much shorter time than the inner wall by reason of the fact that it is directly exposed to weathering agencies, to abrasion caused by wind loaded with dust particles, to chemical pollutants and aggressive agents and to solar radiation which has a damaging effect on plastic materials. It is thus necessary after a certain time to replace the outer wall. This operation is complicated and costly since it entails the need to dismantle the entire structure.

Furthermore, the known double-wall structures have the disadvantage of providing a lower level of interior lighting than single-wall structures by reason of the fact that the double wall thickness reduces the transmission of light from the exterior.

It is thus apparent that, at times of the year when the heat insulation provided by the double wall serves no purpose, it is desirable to reduce the number of walls to one in order to derive maximum benefit from natural daylight lighting. However, taking into account the difficulties involved in disassembly of known structures, this conversion is very hard to achieve, with the result that it is found preferable to adopt artificial interior lighting.

Moreover, it would be preferable to have the possibility of readily dismantling the entire structure during the summer, for example, in the event that it is more agreeable to practice a sport or to play a game in a completely uncovered area.

The aim of the present invention is to overcome the disadvantages of known forms of construction by providing an inflatable structure in which either partial or total assembly and disassembly operations can be carried out with particularly great ease while having a very low weight, excellent mechanical strength, and a long service life in comparison with existing structures.

The inflatable structure contemplated by the invention comprises a flexible envelope having a single or double wall which is placed during service above the area to be protected, which has a base connected to the ground by means of an anchoring device and which is maintained in the distended condition during service by a pressure which exceeds atmospheric pressure.

In accordance with the invention, this inflatable structure is distinguished by the fact that the wall or walls of the envelope are each joined to the base by means of a detachable assembly device such as a zipper-type slide fastener which permits assembly or disassembly of each wall independently of the other.

It is thus a very easy matter for example to remove the outer wall while leaving the inner wall in position, especially after the winter months, at a time when the heat insulation provided by the two walls is no longer indispensable and when a single wall makes it possible to obtain better lighting of the interior.

Furthermore, the fact that the outer wall can readily be removed permits storage of this latter over long periods of time without being exposed to weathering and aggressive external agents, thus considerably extending the service life of the wall.

In an advantageous embodiment of the invention, the base has a cross-section substantially in the shape of a Y, the central wall of which is adapted to carry the device for anchoring the structure to the ground. The two branches are each fitted with one of the strips for connection of the slide fastener. The other strip is placed on the perimeter of the detachable wall.

By virtue of this Y-shaped cross-section of the base, the two walls can be removed independently of each other without entailing any need to remove the base. Each branch of the base sustains the tensile stresses applied to the corresponding wall, with the result that removal of one wall does not produce any unbalance of the forces applied in tension and consequently does not require any operation involving the need to re-apply tension to the other wall.

In a preferred embodiment of the invention, the two detachable walls of the double envelope are cut-out in accordance with a substantially identical pattern and are interchangeable.

To this end, it is only necessary to provide unequal lengths for the branches of the Y-section base. By virtue of the interchangeability of the walls, erection of the structure is facilitated by the fact that there is no need for accurate position location of the walls with respect to each other. Moreover, it is possible after a certain time to put the inner wall in the place of the outer wall, thus extending the lifetime of the structure.

These walls are advantageously made of a plasticized fabric which is both thin, flexible, lightweight and impermeable. Preferably, this fabric is composed of polyester resin fibers and the plasticizing layer is either of acrylic resin or of polyurethane. The density of this fabric is lower than 200 $g/m^2$.

This low density essentially facilitates the assembly and disassembly of the envelope.

A further point worthy of note is that, by virtue of the flexibility and lightness of weight of these walls, they are readily deformable under the action of wind and are thus capable of assuming an optimum aerodynamic profile which reduces the action of wind on the structure.

In an advantageous embodiment of the invention, the two walls of the envelope are maintained at a distance from each other by a gas pressure of intermediate value between the internal pressure and the external pressure.

To this end, the structure comprises means for establishing within the inner envelope a pressure which is higher than atmospheric pressure, means for permitting controlled leakage of a gaseous fluid such as air into the internal space formed between the two walls, and means for permitting controlled leakage of said gaseous fluid to the external atmosphere.

Other features of the invention will be more apparent upon consideration of the following description and accompanying drawing, wherein.

Figure 1:
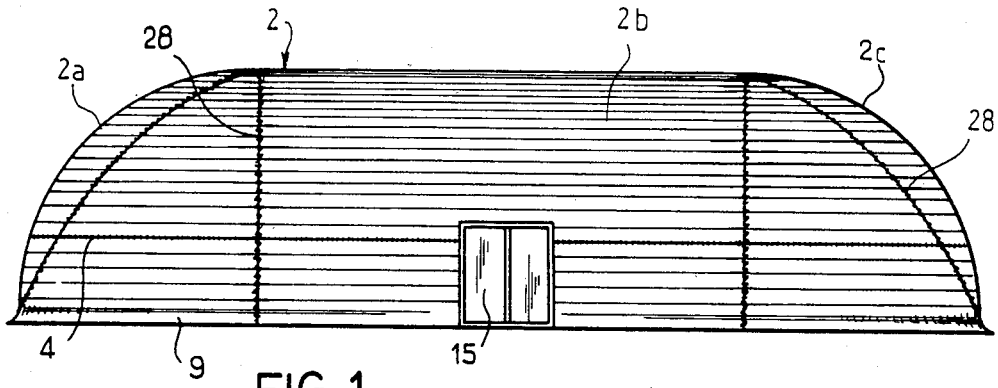
FIG. 1 is a view in elevation showing an inflatable structure in accordance with the invention.
Figure 2:
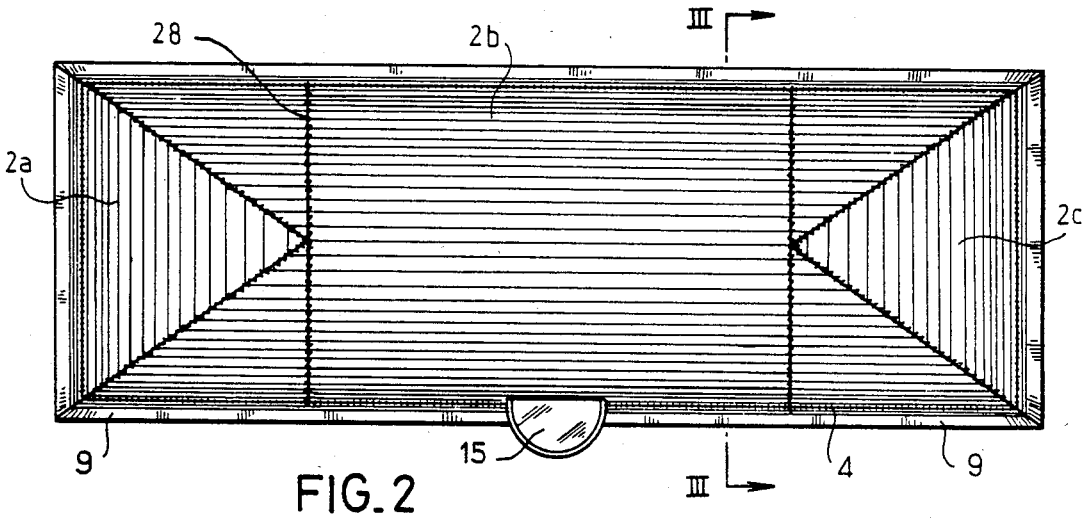
FIG. 2 is a top view of said structure.
Figure 3:
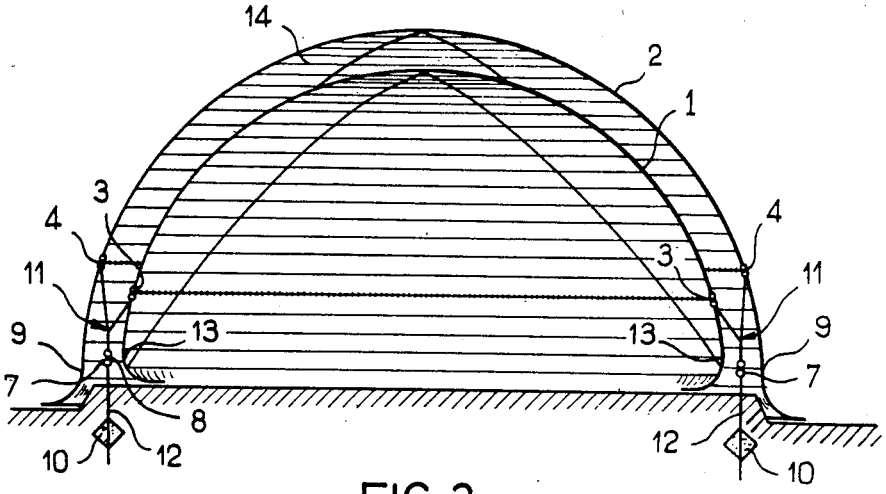
FIG. 3 is a sectional view of the structure taken along the plane III—III of FIG. 2.

In the embodiment of FIGS. 1 to 3, the inflatable structure in accordance with the invention comprises a flexible envelope which consists either of a single wall or of an inner wall 1 and an outer wall 2 which extend over the area to be protected.

These walls 1 and 2 are constituted by an assembly of strips of plastic fabric such as, for example, of polyester resin fibers, the strips being thin, flexible, lightweight, impermeable, and assembled together by sewing, for example.

By way of example, the plasticizing layer of said fabric is of acrylic or polyurethane resin. The density of this fabric is substantially within the limit of 200 $g/m^2$.

Provision is made on one of the lateral faces of the structure for a revolving door unit 15 through which persons are permitted to pass without producing permanent air escape.

The envelope of the structure comprises a base 11 connected to the ground by means of an expansion-type anchoring device 12 which comprises vertical rods fixed in the ground.

The envelope of the structure is maintained in the distended state during service by means of a pressure which is higher than atmospheric pressure as will be described in detail hereinafter.

Figure 5:
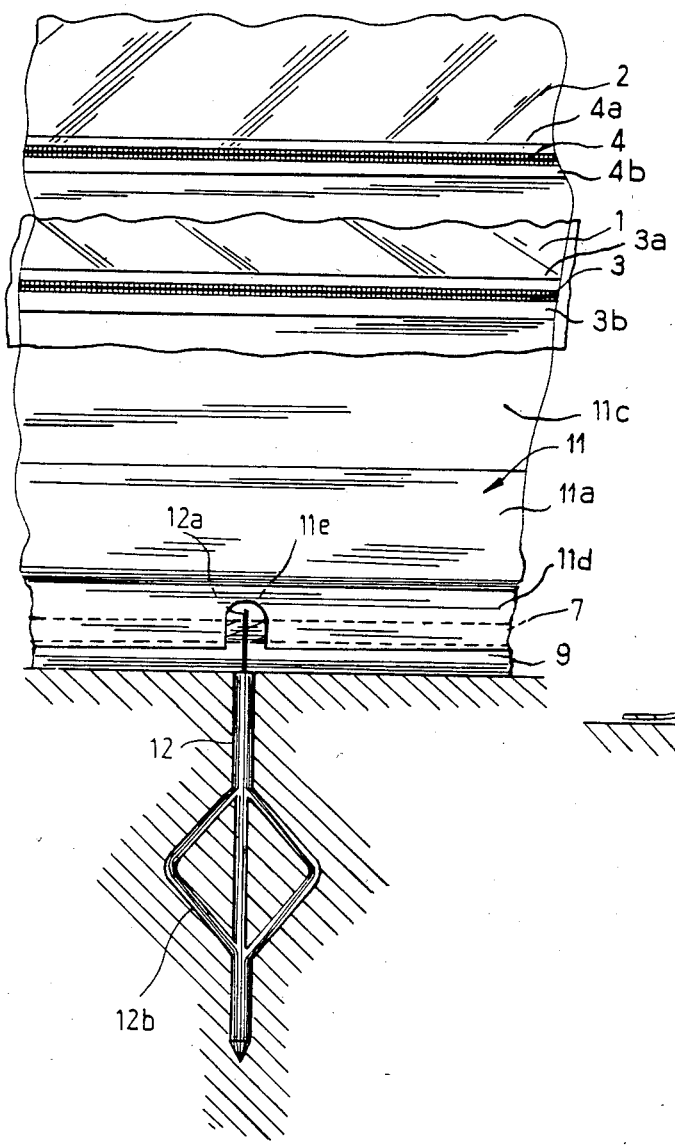
FIG. 5 is a sectional view taken along line V—V of FIG. 4.
Figure 4:
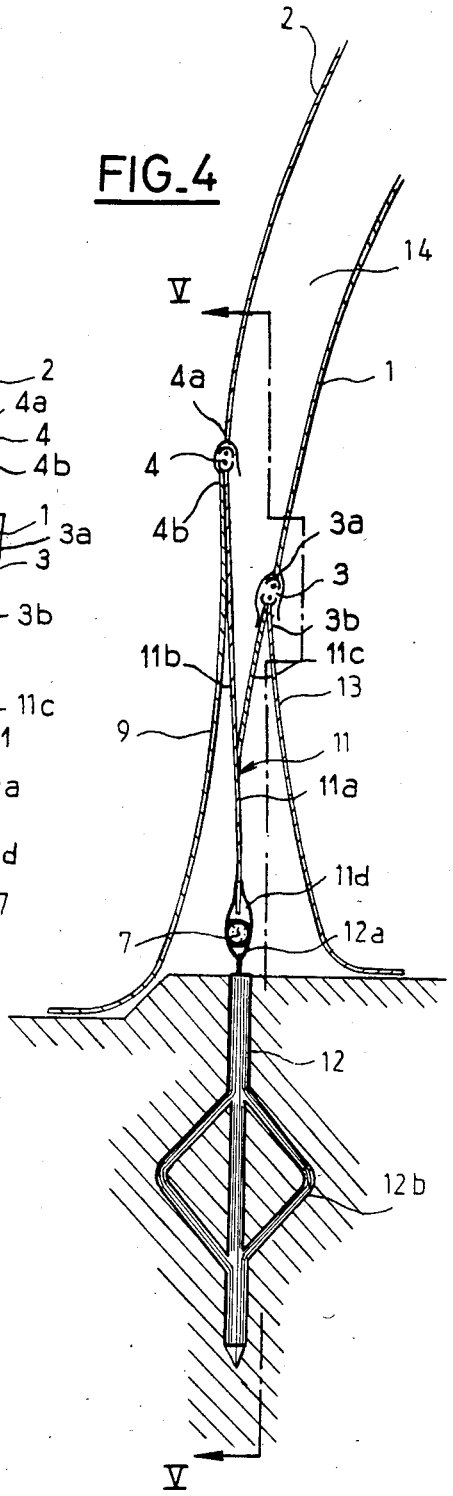
FIG. 4 is a fragmentary transverse sectional view to a larger scale, showing the base and the anchoring device.

The two walls 1, 2 of the envelope are each connected to the base 11 by means of a detachable assembly device which is constituted in the example shown by zipper-type slide fasteners 3, 4 (as shown in FIGS. 4 and 5) which serve to assemble or disassemble the walls 1, 2 independently of each other.

As shown in FIGS. 4 and 5, the anchoring device further comprises an attachment cable 7 arranged along the perimeter of the area to be protected and passed through metal loops 12*a*. Said loops are joined mechanically to anchoring rods 12 which are driven into the ground and the lower portion of which comprises expanded elements 12*b* which are embedded in the ground, thus maintaining the entire assembly securely connected to the ground.

The base 11 is provided at its lower end with a sheath 11*d* constituted for example by a loop of reinforced fabric sewn along the entire length of the bottom edge of the base 11. Said sheath 11*d* is provided with recesses 11*e* directly above the metal loops 12*a* of the anchoring rods 12.

The cable 7 is threaded within the sheath 11*d* which is sewn to the base 11 along the entire length of this latter. The cable therefore passes alternately within a loop 12*a* and within a portion of the sheath 11*d* between two recesses.

As shown in FIGS. 3 and 4, the base 11 has a Y-shaped transverse cross-section.

The two upper arms 11*b*, 11*c* of the base 11 are each provided with one of the strips 3*a*, 4*a* for attachment to the slide fasteners 3, 4 whilst the other strip 3*b*, 4*b* is placed on the perimeter of each detachable wall 1, 2.

The branch 11*b* of the base 11 which is joined to the outer wall 2 (as shown in FIG. 4) has a length which exceeds that of the branch 11*c* which is joined to the inner wall 1 in order to ensure that the two detachable walls 1, 2 can be cut-out to a practically identical pattern and can thus be interchangeable.

Bottom flaps 9, 13 are attached respectively to the ends of the branches 11*b*, 11*c* of the base 11 and extend around the entire structure on each side of the central portion 11*a* of the base 11 and come into contact with the ground, thus making the bottom portion of the structure substantially water-tight both inside and outside.

In the distended position of the structure, the two walls 1, 2 are maintained at a distance from each other by a gas pressure of intermediate value between the internal pressure and the external pressure.

Figure 6:
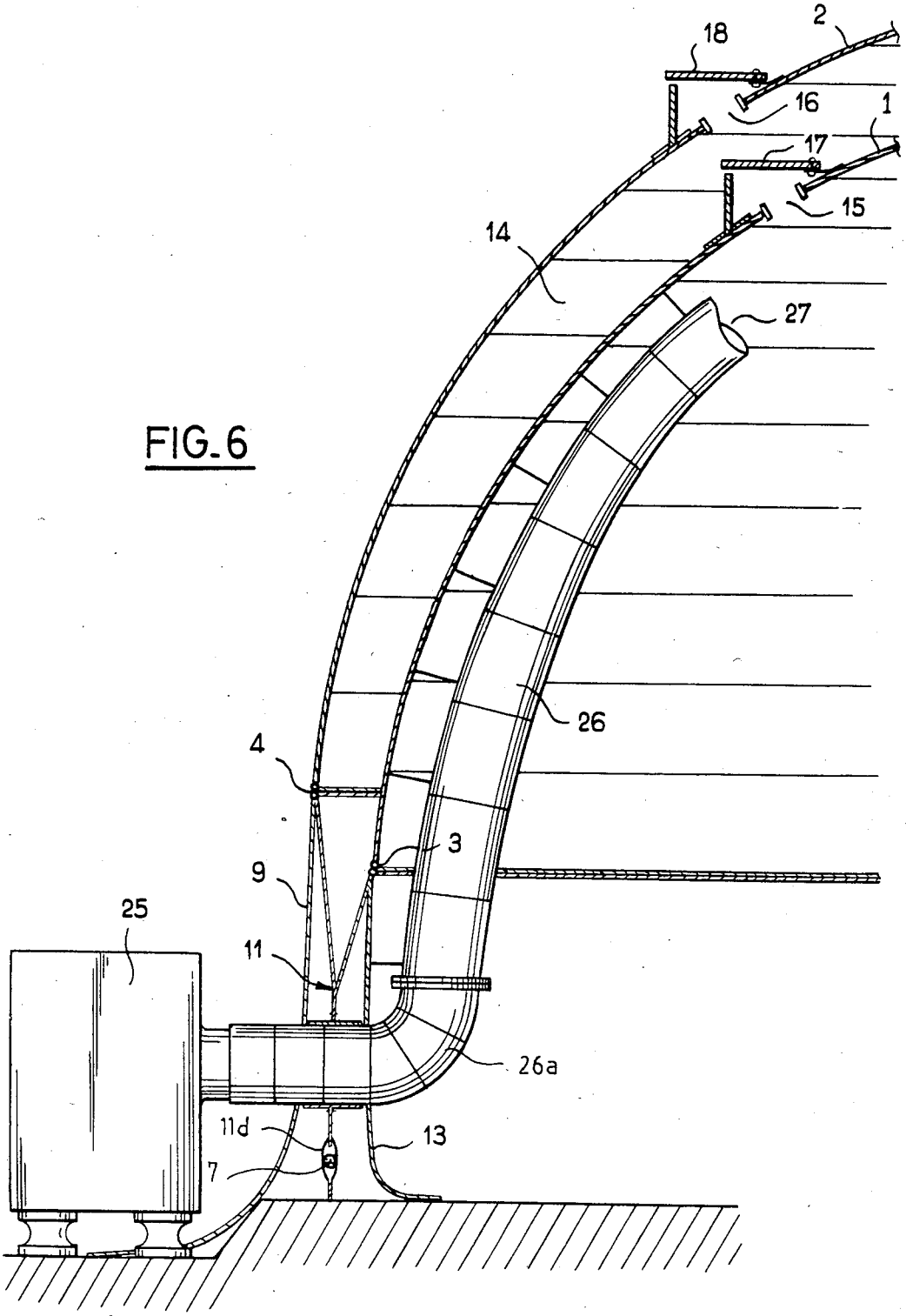
FIG. 6 is a transverse part-sectional view showing the device for pressurizing the internal space between the two walls.

As shown in FIG. 6, the pressurizing means comprise a compressor 25 for a gaseous fluid such as air. Said compressor is placed outside the structure and delivers this fluid under pressure into the interior of the structure via a duct 26*a* located at the bottom of said structure.

A removable chimney 26 can be joined to the duct 26*a* by suitable connecting means. Said chimney extends along the inner wall 1 to the upper portion of this latter.

This arrangement makes it possible to maintain a suitable pressure on the inside of the inner wall 1. The chimney 26 can be put into service under very cold weather conditions. Thus the cold air which comes from the exterior is propelled by the compressor 25, directed towards the top portion of the structure and not towards the ground where games or sporting activities may be taking place.

The upper end 27 of said removable chimney 26 is located near a vent 15 which communicates by means of a valve 17 with the internal space 14 formed by the two walls 1, 2.

The valve 17 is pivotally mounted on the inner wall 1 and its weight determines the opening pressure.

The internal space 14 formed between the two walls 1, 2 in turn communicates with the external atmosphere via a second opening 16 formed in the external wall 2 and located slightly above the first opening 15. Said second opening is also provided with a valve 18.

The operation of these means for pressurizing the structure permits satisfactory distension of the envelope, whether provision is made for one or two walls and whether the removable chimney is in position or not, this being made possible by the flexibility of operation of the valves 17 or 18.

In order to erect the structure described in the foregoing, the procedure is as follows:

The first step consists in embedding in the ground the anchoring rods 12 equipped with expansion anchors 12*b* of known type which maintain the rods 12 securely connected to the ground. In addition, the cable 7 is inserted in the sheath 11*d* of the base 11. At the level of each recess 11*e* of said sheath 11*d*, said cable 7 is also passed through the rings 12*a* of the rods 12 over the entire length on each side of the area to be protected. Tension is then applied to the ends of the cable 7.

The inner wall 1 is then attached to the branch 11*c* of the base 11 by means of the zipper-type slide-fastener 3, whereupon the outer wall 2 is attached to the branch 11*b* by means of the slide fastener 4.

The compressor 25 is placed in position, followed by the blower duct 26*a* and then by the chimney 26. The compressor 25 is started up, with the result that air at a pressure above atmospheric pressure is blown into the internal space of the structure. This has the effect of inflating the inner wall 1.

Experience has shown that an internal pressure of 2.5 to 3 millibars is sufficient to obtain good distension of the inner wall 1. The weight of the valve 17 is calculated so that it is capable of lifting when the internal pressure exceeds the value mentioned above and thus permitting a controlled leakage of air into the internal space 14 provided between the two walls 1, 2. This controlled leakage of air into the internal space 14 has the effect of inflating the outer wall 2. When the air pressure within this internal space 14 attains 1 to 1.5 millibar, the valve 18 of the outer wall 2 is lifted and thus permits controlled air leakage to the external atmosphere.

Once the structure is in the fully distended state, the rate of flow of air under pressure can be reduced to a value which is just sufficient to maintain the structure in its distended state and to avoid excessive cooling within the interior of the structure.

Erection of the inflatable structure in accordance with the invention is a very rapid operation. Thus in the case of a structure which is intended to cover a tennis court having a length of 36 m and a width of 18 m, the erection time does not exceed two and one-half hours. This result is obtained in particular by virtue of the means employed for rapid fastening of the walls 1 and 2 to the base 11 and also by virtue of the light weight of the detachable walls 1 and 2. In fact, in the case of the example mentioned above, the weight of each wall is less than 90 kg.

Since the walls 1 and 2 are interchangeable, each wall can be placed indifferently on the inside or on the outside. Thus, in view of the fact that the outer wall 2 is subject to more rapid degradation than the inner wall 1, it is possible to double the service life of the complete envelope by periodically reversing these walls.

Moreover, it is an advantage after the winter season to remove the outer wall 2 and to retain only the inner wall 1 since the weather conditions at this time of the year no longer justify the heat insulation provided by the air layer between the two walls.

The outer wall 2 can then be stored and protected against the effects of bad weather and sunshine, thus extending its period of useful life.

Furthermore, removal of this outer wall 2 provides better interior lighting of the structure, thus making the games and sports area particularly agreeable for all users and players.

The exchange of walls 1, 2 or the removal of only one wall can very readily be performed by means of detachable assembly devices consisting of the zipper-type slide fasteners 3, 4.

Moreover, by reason of the ease with which the removable walls 1, 2 can be detached from the structure, users do not hesitate to remove them completely in order to derive maximum benefit from favorable periods of sunshine, even when such periods are of short duration.

FIGS. 1 and 2 show diagrammatically that each wall 1, 2 can be made up of three detachable elements, namely a central element 2*b* of approximately cylindrical shape and two end elements 2*a*, 2*c* in the shape of a half-cupola. These elements are joined to each other by detachable connection means 28 such as zipper-type slide fasteners, for example.

When the envelope is not distended under the action of an internal pressure and rests on the ground, each of the elements mentioned above can be detached or assembled.

Figure 7:
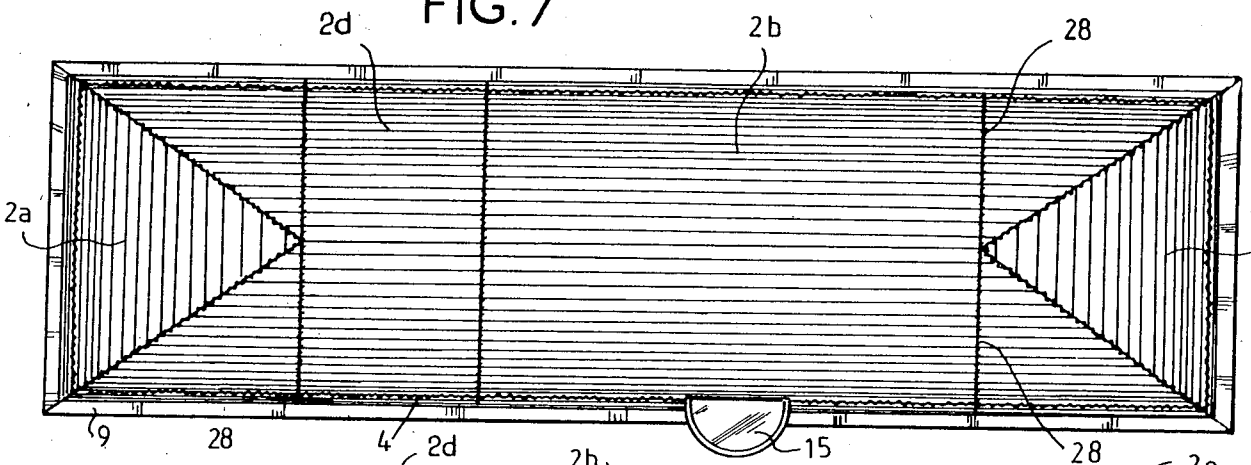
FIG. 7 is a top view of the structure comprising an intercalary element.
Figure 8:
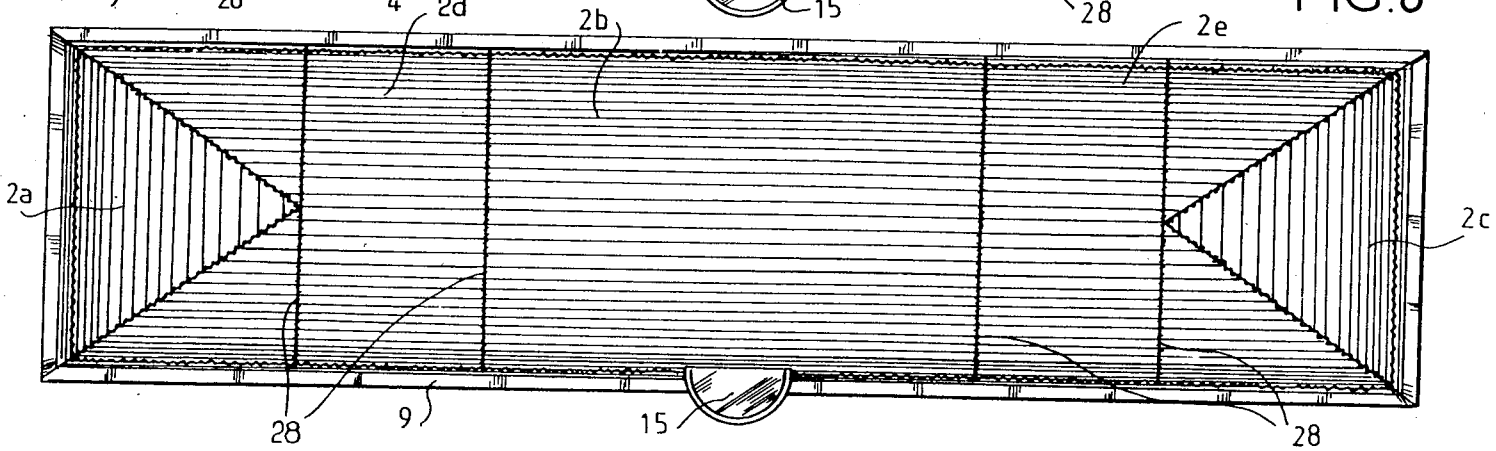
FIG. 8 is a top view of the structure comprising two intercalary elements.

FIG. 7 is a schematic diagram showing an intercalary element 2*d*, the shape of which is substantially a section of central element 2*b*. Said intercalary element is intended to be interposed between the central element 2*b* and an end element such as the element 2*a*.

The aforementioned intercalary element 2*d* is provided at its edges with the same detachable connection means 28 in order that it may be joined on the one hand to the central element 2*b* and on the other hand to the end element 2*a*. Said intercalary element is provided along its bottom edge with the same detachable assembly means 3, 4 as those of the walls 1, 2. Said means are intended to be joined to a base 11 having a length equal to the length of the intercalary element.

When all the detachable connection and assembly means have been joined together, the complete structural assembly can be put under pressure and distended, thus constituting a new wall which has all the characteristics of the initial wall and the length of which is the sum of lengths of the initial wall and of the intercalary element.

An intercalary element can be interposed just as readily in the inner wall 1 as in the outer wall 2. An increase in length of the envelope is thus possible, whether this latter has either one or two walls.

This arrangement makes it possible to extend the structure by a length equal to that of the intercalary element after the cables 7 and the anchoring devices 12 have been arranged for this purpose at the level of the ground.

A second or even a third intercalary element 2*e* can be joined to the walls 1, 2 in accordance with the same arrangements.

The structure having one or two walls can thus have a number of different lengths in accordance with the user's requirements.

This offers a further advantage in that it permits industrial manufacture of this structure in accordance with a modular design comprising a central element, an end element and an intercalary element. This arrangement consisting of three modular elements consequently reduces the costs of study, tooling, manufacture and management.

Starting from three different elements, namely a central element, an end element and an intercalary element in suitable numbers, it is possible to obtain a large number of combinations and thus to form a structure having one wall (one central element, two end elements) or a structure having two walls (two central elements, four end elements). Each version of the structure can be increased in length according to requirements by interposing a suitable number of intercalary elements.

It should be clearly understood that the invention is not limited to the example described in the foregoing and that many modifications can accordingly be contemplated without thereby departing either from the scope or the spirit of the invention.

Thus the slide fasteners 3, 4 can be replaced by other rapid fastening devices such as press-studs, adhesive strips of the Velcro fastener type and the like.

Furthermore, the detachable walls 1, 2 could be made of a polyamide fiber fabric of the Kevlar type or of Goretex (polyamide fiber fabric coated with a layer of polytetrafluoroethylene).

It will be readily apparent that, in the case of inflatable structures having large dimensions, provision could be made for a plurality of air admission ducts 26*a* and for a plurality of valves 17, 18 for each of the detachable walls 1, 2.

Moreover, the general shape of the structure could be different from the shape described in the foregoing.

What is claimed is:

1. An inflatable structure for use as a shelter in order to cover a predetermined area, said structure being composed of a flexible envelope having a double wall comprised by inner and outer walls, which is placed during service above the area to be protected, said structure having a base connected to the ground by means of an anchoring device, said envelope being maintained in the distended condition during service by a pressure which exceeds atmospheric pressure, wherein the walls of the envelope are each joined to the base by means of a slide fastener comprised of two detachable strips which permits assembly or disassembly of each wall independently of the other, the base having a cross-section substantially in the shape of a Y having two branches and a central wall, the central wall of said base being adapted to carry said device for anchoring the structure to the ground and said two branches of the base being each provided with one said strip for connection of a said slide fastener, the other strip of each said slide fastener being disposed on the perimeter of a respective said wall, the branch of said base which is joined to said outer wall of the envelope having a length which exceeds that of the branch which is joined to the inner wall of the envelope and the two said walls of the envelope having a substantially idential size and shape and being interchangeable.

2. An inflatable structure according to claim 1, wherein said structure comprises means for establishing a pressure which is higher than atmospheric pressure within the internal space on the inside of said inner wall, means permitting controlled leakage of a gaseous fluid into an internal space between the two walls, and means permitting controlled leakage of said gaseous fluid from said internal space to the external atmosphere.

3. An inflatable structure according to claim 2, wherein the means establishing a pressure comprise a duct for delivering a gaseous fluid under pressure into the interior of the envelope and wherein a chimney connected to said duct by detachable means conveys said gaseous fluid toward the top of the envelope in the vicinity of a valve which provides a communication with said internal space between the two walls of the double envelope, said internal space being in turn in communication with the external atmosphere by means of a second valve located in the vicinity of the first mentioned valve.

4. An inflatable structure according to claim 1, where in each of the two branches of the base carries a sealing flap which extends at least down to the ground on each side of the central portion of said base.

* * * * *